US007690293B2

(12) United States Patent
Bensley et al.

(10) Patent No.: US 7,690,293 B2
(45) Date of Patent: Apr. 6, 2010

(54) COUPLING SYSTEM FOR USE WITH FLUID DISPLACEMENT APPARATUS

(75) Inventors: Douglas S. Bensley, Ludlow, VT (US); Robert C. Demers, Springfield, VT (US); James V. Bruno, Milford, MA (US)

(73) Assignee: Ivek Corporation, North Springfield, VT (US)

( * ) Notice: Subject to any disclaimer, the term of this patent is extended or adjusted under 35 U.S.C. 154(b) by 579 days.

(21) Appl. No.: 11/620,188

(22) Filed: Jan. 5, 2007

(65) Prior Publication Data

US 2008/0166248 A1 Jul. 10, 2008

(51) Int. Cl.
*F01B 9/00* (2006.01)
*F16J 1/10* (2006.01)

(52) U.S. Cl. ..... 92/136; 74/89.34; 403/DIG. 1

(58) Field of Classification Search ..... 92/136, 92/138, 140, 165 PR; 74/89.33, 89.34; 403/DIG. 1
See application file for complete search history.

(56) References Cited

U.S. PATENT DOCUMENTS 4,528,161 A * 7/1985 Eckert ..... 222/191
4,671,123 A 6/1987 Magnussen, Jr. et al.
4,779,467 A 10/1988 Rainin et al.
4,790,236 A * 12/1988 Macdonald et al. ..... 92/129
4,932,313 A 6/1990 Gutknecht
5,425,763 A * 6/1995 Stemmann ..... 403/DIG. 1
6,254,832 B1 7/2001 Rainin et al.
6,408,706 B1 * 6/2002 Nagai et al. ..... 74/89.33
6,499,907 B1 * 12/2002 Baur ..... 403/DIG. 1
6,736,049 B2 * 5/2004 Cautenet et al. ..... 92/187
6,739,478 B2 5/2004 Bach et al.
7,541,707 B2 * 6/2009 Hochhalter et al. ..... 74/89.34

OTHER PUBLICATIONS

US Office Action dated Nov. 15, 2007, received in related application No. 11/113,531, 9 pgs.
US Office Action dated May 17, 2007, received in related U.S. Appl. No. 11/113,531, 13 pgs.

* cited by examiner

*Primary Examiner*—Thomas E Lazo
(74) *Attorney, Agent, or Firm*—Grossman Tucker Perreault & Pfleger, PLLC

(57) ABSTRACT

A magnetic coupling system may be used in a fluid displacement apparatus to magnetically couple a drive shaft to a piston. The magnetic coupling system may include first and second magnetic couplers at the ends of the drive shaft and piston, respectively. The second magnetic coupler is configured to magnetically engage the first magnetic coupler and configured to mechanically engage the first magnetic coupler if the couplers disengage magnetically.

20 Claims, 5 Drawing Sheets

COUPLING SYSTEM FOR USE WITH FLUID DISPLACEMENT APPARATUS

CROSS-REFERENCE TO RELATED APPLICATIONS

This application is related to U.S. patent application Ser. No. 11/113,531, filed Apr. 25, 2005, which claims the benefit of U.S. Provisional Patent Application Ser. No. 60/565,108, filed on Apr. 23, 2004, which is fully incorporated herein by reference.

TECHNICAL FIELD

The present invention relates to coupling systems and more particularly, to a magnetic coupling system for use with a fluid displacement apparatus.

BACKGROUND INFORMATION

Fluid transfer devices (e.g., pipette mechanisms and pumps) are used to aspirate, dispense and transfer small volumes of fluid in many applications. The devices may range from simple glass tubes to more elaborate mechanical displacement devices. In either case, the devices operate by displacing fluid and a seal is used to hold the displaced fluid, which facilitates the liquid transfer. Traditional devices use displacement pistons with mechanical seals, such as lip seals or o-rings, to prevent air from entering the displacement chamber. These seals can be run dry, and wear eventually causes the seal to leak and degrades accuracy of the device.

Such devices may use a linear actuator to provide linear motion to the displacement piston. Couplings and other structures may be used to couple the linear actuator to the displacement piston. Misalignment of the actuator to the piston may result in premature seal degradation and may adversely affect the accuracy of the device during fluid transfer.

BRIEF DESCRIPTION OF THE DRAWINGS

These and other features and advantages will be better understood by reading the following detailed description, taken together with the drawings wherein.

DETAILED DESCRIPTION

Figure 1:
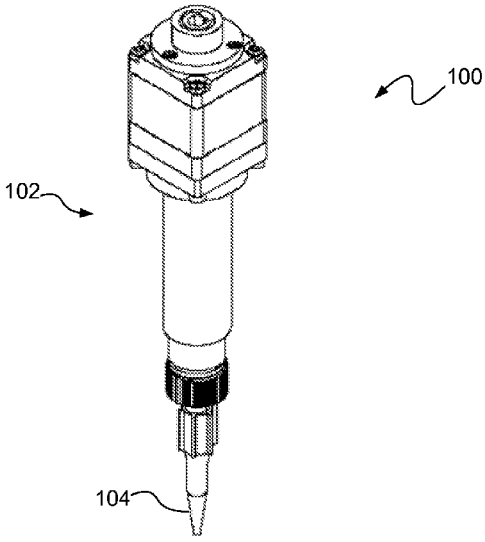
FIG. 1 is a perspective view of a fluid transfer device, consistent with one embodiment of the present invention.

Referring to FIG. 1, a fluid transfer device 100, consistent with one embodiment of the present invention, may include a liquid sealed fluid displacement apparatus 102 and a fluid receiving member 104. The fluid displacement apparatus 102 may be used to displace precise volumes of fluid into a displacement chamber. Displacing the fluid creates a negative pressure in the displacement chamber (i.e., suction), which may cause a precise volume of fluid to be drawn into the fluid receiving member 104. In one embodiment, the fluid displaced by the displacement apparatus 102 is air and the fluid drawn into the fluid receiving member 104 is a liquid. Those skilled in the art will recognize that various other fluids (both gases and liquids) may be displaced and/or transferred. The fluid transfer device 100 and/or displacement apparatus 102 may thus be used in fluid dispensing and metering applications, such as pipetting, aliquoting, and bulk dispensing.

The fluid receiving member 104 may be removably coupled to the displacement apparatus 102. The fluid receiving member 104 includes a fluid passage or channel that is capable of receiving a volume of fluid and is in communication with the displacement chamber. Examples of the fluid receiving member 104 include, but are not limited to, a cannula, plastic tubing, a conical pipette tip, or a stainless nozzle. Those skilled in the art will recognize that various types of fluid receiving members may be coupled to the displacement apparatus 102 for use in various types of applications.

Figure 2:
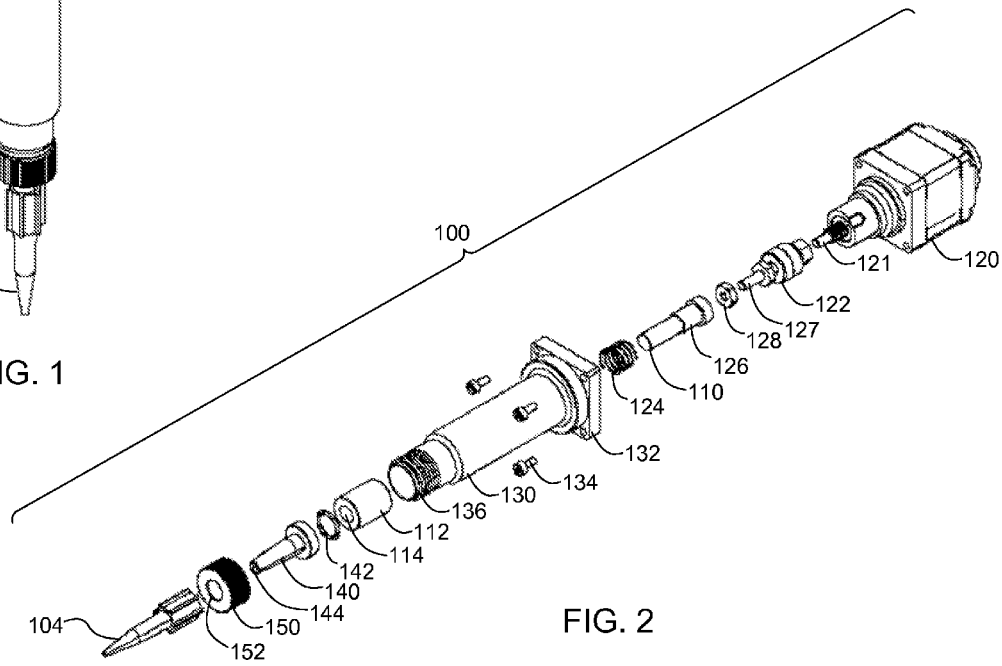
FIG. 2 is an exploded perspective view of the fluid transfer device shown in FIG. 1.
Figure 3:
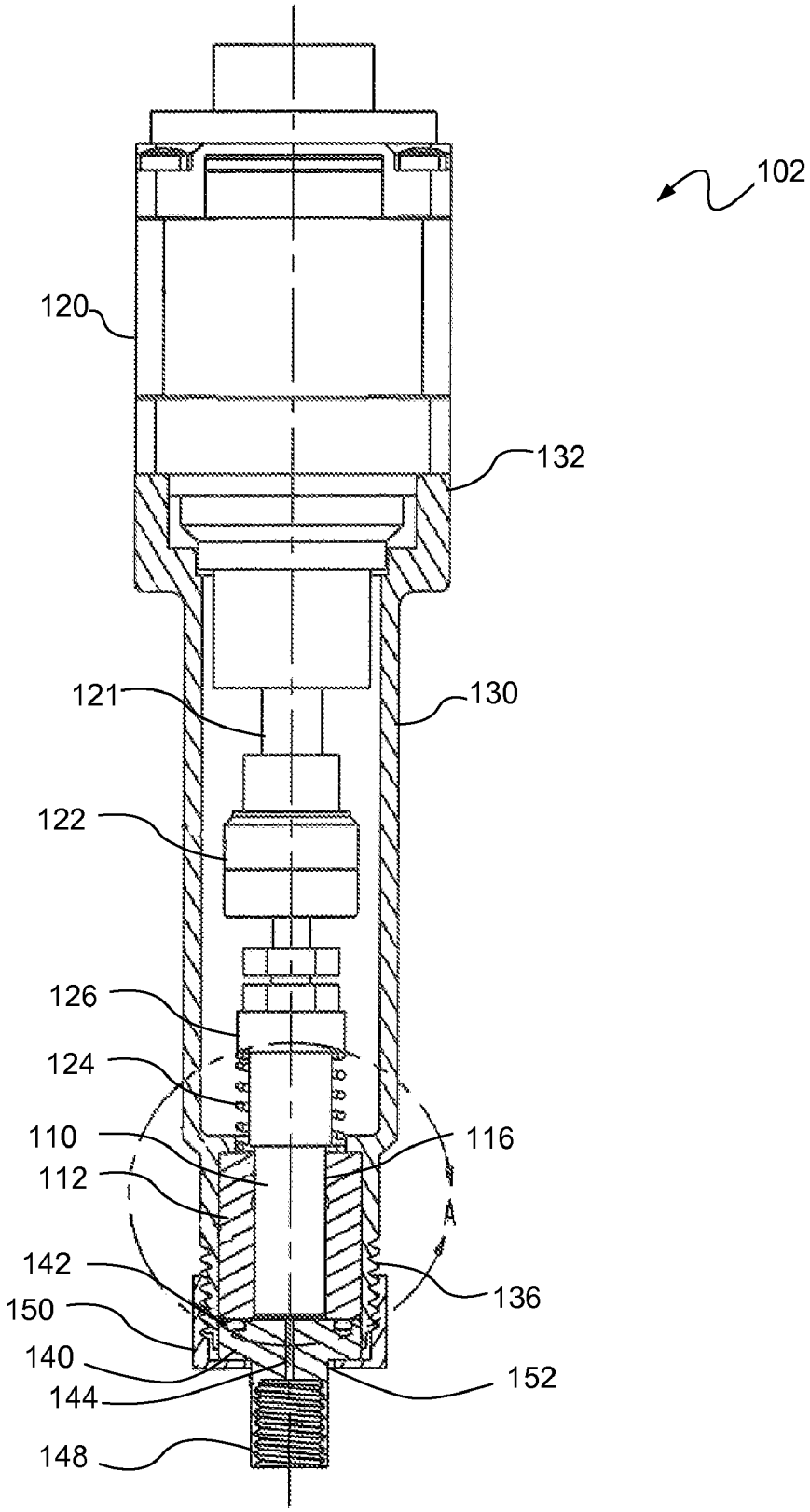
FIG. 3 is a cross-sectional view of a liquid sealed fluid displacement apparatus that may be used in a fluid transfer device, consistent with one embodiment of the present invention.

Referring to FIGS. 2 and 3, one embodiment of the fluid displacement apparatus 102 includes a piston 110 and a cylinder 112 receiving the piston 110. The cylinder 112 defines a displacement chamber 114, and the piston 110 causes displacement of fluid, such as air, when the piston 110 retracts from the displacement chamber in the cylinder 112. The piston 110 and the cylinder 112 may define a close clearance 116 configured to receive a sealing fluid. The clearance 116 may be configured with a dimension to maintain the sealing fluid between the piston 110 and the cylinder 112. In other words, the tight fit of the piston 110 and the cylinder 112 substantially prevents the sealing fluid from leaking out. The total diametrical clearance 116 may be in a range of about 50 to 500 millionths of an inch and more specifically approximately 100 millionths of an inch. One embodiment of the piston 110 and the cylinder 112 may be made of a ceramic material such as alumina or zirconia ceramic.

The sealing fluid in the clearance 116 between the piston 110 and the cylinder 112 prevents fluid from entering the displacement chamber 114 formed when the piston 110 is retracted. The sealing fluid may be a silicone oil or other similar fluid. Those skilled in the art will recognize other types of sealing fluid that are capable of sealing the clearance 116 and that are capable of remaining within the clearance 116.

The fluid displacement apparatus 100 may also include a linear actuator 120 and a coupling 122 between the linear actuator 120 and the piston 110. The coupling 122 may be coupled directly to a drive shaft 121 of the linear actuator 120. The linear actuator 120 may be a lead screw driven captive shaft linear actuator, such as the type available from Hayden Switch & Instrument, Inc. as part no. P28H49-2.1-001. The coupling 122 may be a floating coupling that compensates for angular and lateral misalignment when driving the close clearance ceramic piston/cylinder components.

A compression spring 124 may be positioned against the piston 110 biasing the piston away from the cylinder 120 to compensate for axial backlash, which may be present in the coupling 122 and/or the lead screw in the linear actuator 120. According to one embodiment, the piston 110 may include a piston cap 126 having at least two diameters. The spring 124 may be captured between the piston cap 126 and the cylinder 112 such that the spring 124 is under compression (e.g., approx. 2 lbs.) when the piston 110 is fully inserted into the cylinder 112. The piston cap 126 may be made of metal and may be attached to the piston 110 by interference fit, adhesive bonding, or other mechanical fastener. The coupling 122 may be coupled to the piston cap 126 using a threaded stud 127 and lock-nut 128.

A housing 130 may be coupled to the linear actuator 120 and may enclose at least the piston 110, the cylinder 112, the coupling 122, and the spring 124. The linear actuator 120 may be coupled to one end 132 of the housing 130, for example, using fasteners 134. The cylinder 112 may be rigidly mounted within the other end 136 of the housing 130. The piston 110 and the coupling 122 may be located within the housing 130 in a manner that allows the piston 110 and the coupling 122 to move axially within the housing 130. Although the housing 130 is shown as generally cylindrical, the housing may have other shapes and configurations.

A port fitting connector 140 may be located at the other end 136 of the housing 130, for example, adjacent to the cylinder 112. The end of the cylinder 112 may be sealed with a static o-ring 142 held against the port fitting connector 140. The port fitting connector 140 may include a port passage 144 that provides fluid communication between the displacement chamber 114 and the fluid passage in the fluid receiving member 104. The fluid receiving member 104 may be coupled to the port fitting connector 140, for example, using a commercially available gas tight fitting. One exemplary embodiment of the port fitting connector 140 may include a ¼-28 flat bottom boss 148, although a wide variety of fluid connections may be used. The port fitting connector 140 may allow the fluid receiving device 104 to be easily changed without tools. Those skilled in the art will recognize that various types of commercially available or custom-designed port fitting connectors may be used for different applications.

The port fitting connector 140 may be retained against the cylinder 112 with a cap 150 that engages the end 136 of the housing 130. One embodiment of the cap 150 may threadably engage a straight thread on the end 136 of the housing 130. The cap 150 may include a clearance hole 152 in the center such that the port fitting connector 140 protrudes through the clearance hole 152. The cap 150 may thus secure both the port fitting connector 140 and the cylinder 112 to the housing 130.

Figure 4:
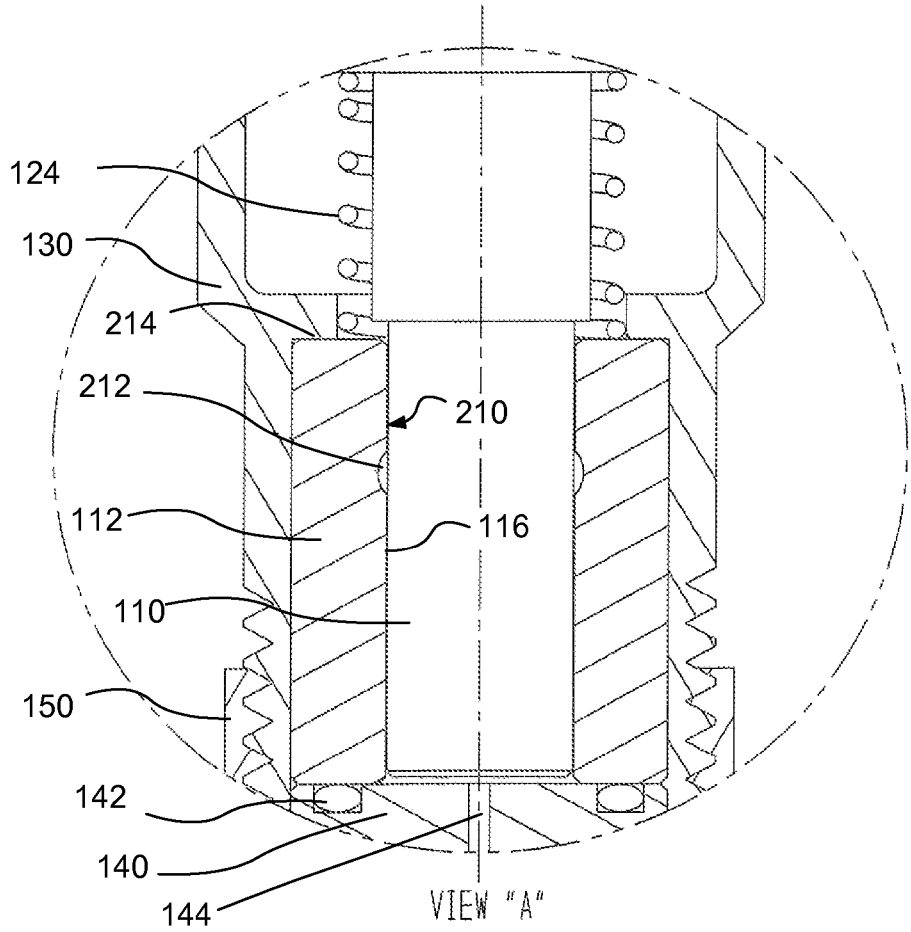
FIG. 4 is an enlarged cross-sectional view of the piston and cylinder arrangement in the liquid sealed fluid displacement apparatus shown in FIG. 3.

According to one embodiment of the piston and cylinder arrangement, shown in FIG. 4, the cylinder 112 includes an inner wall 210 with an annular groove 212, which serves as a sealing fluid reservoir. The sealing fluid may fill the annular groove 212 as well as the clearance 116 between the piston 110 and the cylinder 112. The annular groove 212 may be located about 0.125 inches from the end 214 of the cylinder 112 and may have a depth of about 0.012 inches and a width of about 0.062 inches. Alternatively, the cylinder 112 may not include the annular groove 212 and the sealing fluid may only be in the clearance 116.

Figure 5:
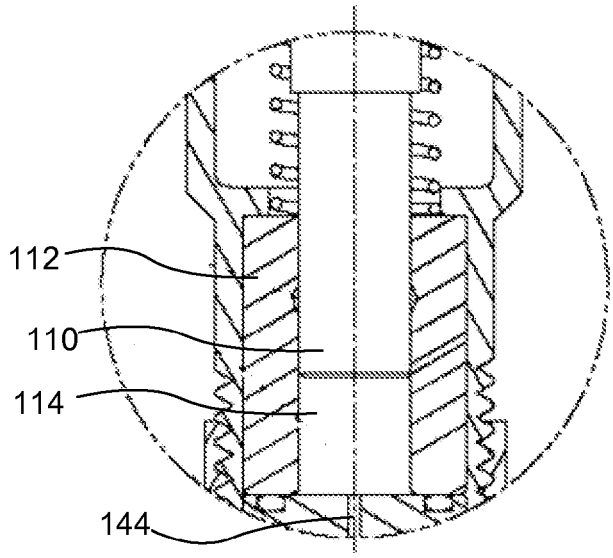
FIG. 5 is an enlarged cross-sectional view of the piston and cylinder arrangement in FIG. 4 forming a displacement chamber.

One method of operation of the fluid displacement apparatus is described in reference to FIGS. 4 and 5. As shown in FIG. 4, the piston 110 may be fully inserted into the cylinder 112 without contacting port fitting connector 140. As shown in FIG. 5, the piston 110 may retract from this position to pull fluid, such as air, into the displacement chamber 114 through the port passage 144 in the port fitting connector 140. In one embodiment, the piston 110 may be retracted up to about 0.25 in.

In use in a fluid transfer application, the fluid receiving member 104 may be coupled to the port fitting connector 140. The piston 110 usually starts in its fully inserted position (as shown in FIG. 4). The fluid receiving member 104 may then be immersed in the sample fluid. The linear actuator 120 may then retract the piston 110 to create suction and pull a desired amount of fluid into the fluid receiving member 104. When the fluid receiving member 104 is charged with a desired amount of liquid, it may be removed from the sample fluid and relocated to a dispensing target. The linear actuator 120 may then be commanded to index the piston 110 into the cylinder 112 and the sample fluid is dispensed out in part or in whole. Those skilled in the art will recognize that there are many possible operational modes. Those skilled in the art will also recognize that the fluid transfer device 100 may be integrated into automated systems using standard controls.

The movement of the piston 110 may be precisely controlled by the linear actuator 120 to control the volume of fluid that is drawn into the fluid receiving member 104 and the volume of fluid that is dispensed from the fluid receiving member 104. Embodiments of the fluid transfer device 100 may be capable of total volumes in a range of less than about 1 μL to over 5000 μL and resolutions in a range from about 0.02 μL/Full Step to 0.20 μL/Full Step. The exemplary embodiment of the fluid transfer device 100 is capable of running for millions of cycles without wear or leakage.

FIGS. 6-10 illustrate one embodiment of a magnetic coupling system that may be used to couple a piston to a drive shaft of a linear actuator, for example, in the embodiments of the fluid displacement apparatus and/or fluid delivery device described above. The linear actuator may include any type of linear actuator that provides movement in a linear direction including, without limitation, a linear actuator using a lead-screw, a linear actuator using an air cylinder, or a linear actuator using a solenoid. In a fluid displacement apparatus or fluid delivery device, the magnetic coupling system may compensate for misalignment when the drive shaft is moving the piston (e.g., during either suction or discharge). The magnetic coupling system may also be used in other piston and cylinder assemblies where a linear actuator is used to drive the piston in the cylinder.

Figure 6:
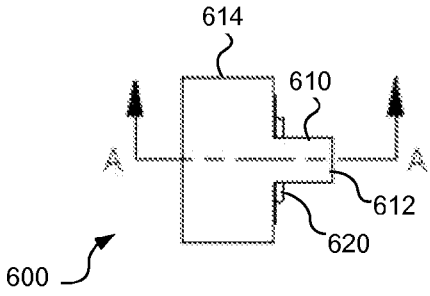
FIG. 6 is a side view of a magnetic coupler, consistent with one embodiment of the present invention.
Figure 7:
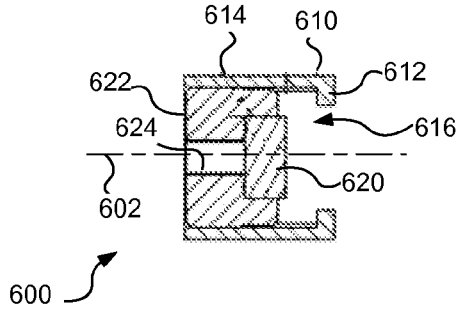
FIG. 7 is a cross-sectional view of the magnetic coupler shown in FIG. 6.

As shown in FIGS. 6 and 7, a first magnetic coupler 600 may be secured to an actuator drive shaft, such as the drive shaft 121 shown in FIG. 2. The first magnetic coupler 600 may include tangs 610 extending longitudinally toward the second magnetic coupler 800 and at least a first magnetic portion or magnet 620. The tangs 610 may include inward portions 612 extending radially inwardly toward a longitudinal axis 602 of the first magnetic coupler 600 to define a coupling region 616 between the tangs 610. The first magnetic portion or magnet 620 is generally located in the coupling region 616 between the tangs 610.

According to one embodiment, the first magnetic coupler 600 may include a hub 622 and the tangs 610 may extend from a ring 614 that is press fit over the hub 622. The hub 622 may also include a recess that receives the magnet 620, for example, with the south pole facing outward. The magnet 620 may be secured in the recess of the hub 622, for example, using an adhesive such as the type known as Loctite® 411. The hub 622 may also include a region 624 configured to receive a portion of the drive shaft to couple the first magnetic coupler 600 to the drive shaft, for example, by threadably engaging an end of the drive shaft. The hub 622 may be made of stainless steel or other suitable material. The ring 614 and tangs 610 may be made of stainless steel or other suitable material. In one example, the magnet 620 may be made of any suitable ferromagnetic material.

Figure 8:
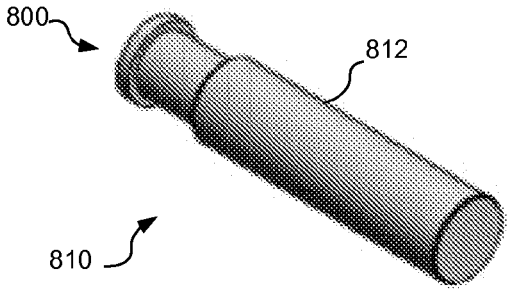
FIG. 8 is a perspective view of one embodiment of a piston including a magnetic coupler configured to engage the magnetic coupler shown in FIGS. 6 and 7, consistent with another embodiment of the present invention.
Figure 9:
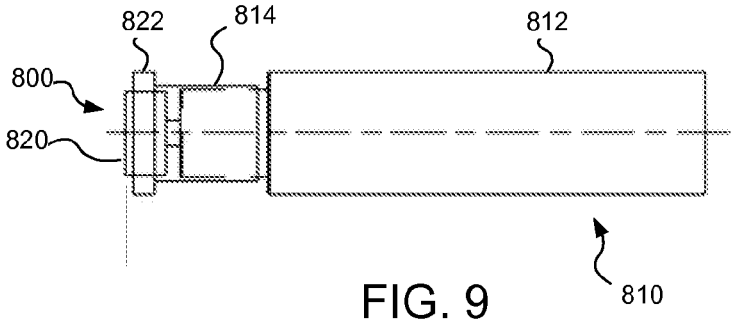
FIG. 9 is a side view of the piston shown in FIG. 8.
Figure 10:
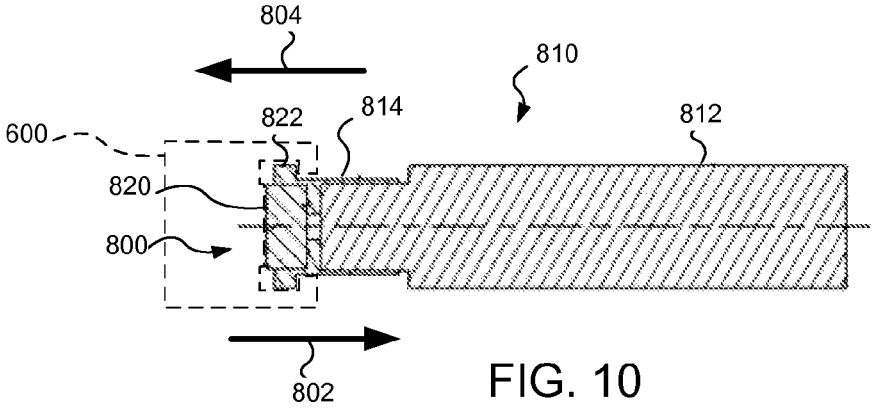
FIG. 10 is a cross-sectional view of the piston shown in FIG. 9.

As shown in FIGS. 8-10, a second magnetic coupler 800 may be located at one end of a piston 810 including a piston body 812 and may be configured to magnetically and mechanically engage the first magnetic coupler 600. The piston body 812 may be configured and dimensioned to fit in a displacement chamber of a cylinder, for example, as described above. The second magnetic coupler 800 may include at least a first magnetic portion or magnet 820 and one or more radial portions 822 extending radially from the coupler 800. The radial portion(s) 822 may include a single radial portion extending annularly around the second magnetic coupler 800 or may include a plurality of radial portions that are spaced annularly around the second magnetic coupler 800.

According to one embodiment, the second magnetic coupler 800 may include an end cap 814 that fits over one end of the piston body 812. The end cap 814 may include the radial portion(s) 822 and a recess that receives the magnet 820, for example, with the north pole facing outward. The end cap 814 may be shrink fit installed over the end of the piston body 812 or secured using other techniques known to those skilled in the art. The magnet 820 may be secured in the recess of the end cap 814, for example, using an adhesive such as the type known as Loctite® 411. The end cap 814 may be made of stainless steel. The magnet 624 may be made of any suitable ferromagnetic material.

To couple the first magnetic coupler 600 and the second magnetic coupler 800, the radial portion(s) 822 of the second magnetic coupler 822 may be positioned in the coupling region 616 of the first magnetic coupler 600. When coupled, as shown in FIG. 10, the first and second magnets 620, 820 may be magnetically engaged as a result of the magnetic forces. There may be a clearance (e.g., of about 0.010 in.) between the tangs 610 and the radial portion(s) 822. Even if the magnets 620, 820 become magnetically disengaged, the inward portions 612 of the tangs 610 may mechanically engage the radial portion(s) 822 to prevent complete decoupling.

During operation of one embodiment of a displacement apparatus including the magnetic coupling system, a displacement stroke may result in the first coupler 600 pushing the piston 810, for example, in the direction of the arrow 802 shown in FIG. 10. A suction stroke may reverse direction with the magnetic forces resulting in the coupler 600 pulling the piston 810 back, for example, in the direction of arrow 804. In the event that the piston 810 resists, the magnets 620, 820 in the first and second couplers 600, 800 may separate, and the inward portions 612 of the tangs 610 may mechanically engage the radial portion(s) 822 to pull the piston 810 back.

In other embodiments, the hub 622, magnet 620, and/or tangs 610 of the first magnetic coupler 600 may be formed as one piece of material and/or the radial portion(s) 822 and the magnetic portion 820 of the second magnetic coupler 800 may be formed as one piece of material. The radial portion(s) 822 and the magnetic portion 820 of the second magnetic coupler 800 may also be formed as one piece of material with the piston body 812. In these embodiments, the material may be a material capable of being magnetized in at least one region to form the magnetic portion.

Figure 11:
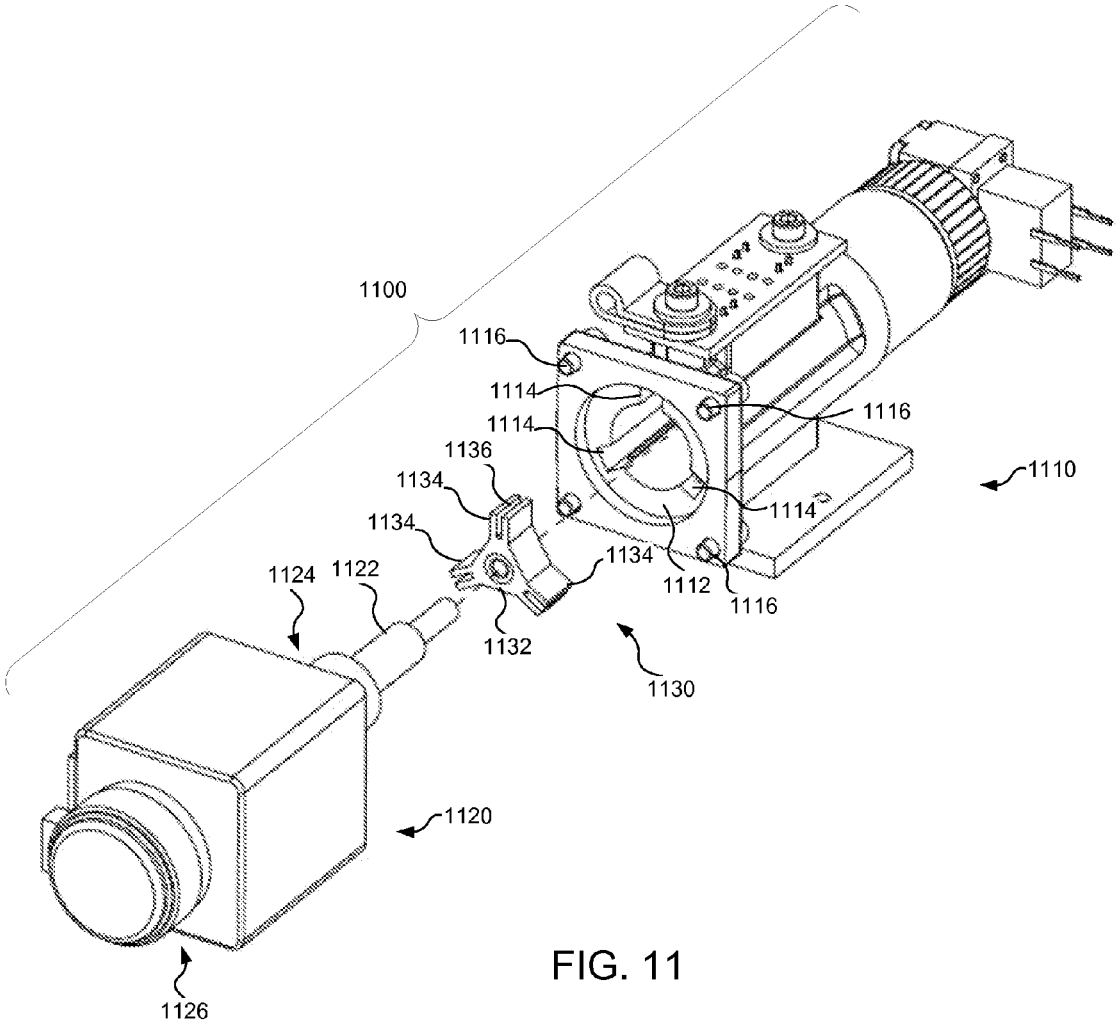
FIG. 11 is an exploded perspective view of another embodiment of a fluid transfer device including an anti-rotation device coupled to a lead screw of an actuator, consistent with yet another embodiment of the present invention.

Referring to FIG. 11, another embodiment of a fluid displacement apparatus 1100 may include a displacement apparatus housing assembly 1110, a linear actuator 1120, and an anti-rotation device 1130 coupled between the housing assembly 1110 and the actuator 1120. The anti-rotation device 1130 prevents rotation of a lead screw 1122 of the linear actuator 1120 as the lead screw 1122 is moved in a linear direction within the housing assembly 1110. The anti-rotation device 1130 may eliminate clearances to improve the accuracy of the linear actuator 1120, as described in greater detail below. Although the anti-rotation device 1130 is used with a fluid displacement apparatus 1100 in the exemplary embodiment, the anti-rotation device 1130, consistent with the embodiments disclosed and shown herein, may be used in other devices in which it is desirable to prevent rotation of a linear actuator.

The housing assembly 1110 may include a housing 1112 with grooves 1114 extending longitudinally along an inner portion of the housing 1112. In one embodiment, the housing assembly 1110 may be part of a fluid displacement apparatus as described above and shown in FIGS. 1-5. The actuator 1120 may include a threaded rotor 1124 that threadably receives the lead screw 1122 and a motor 1126 that rotates the threaded rotor 1124 to move the lead screw 1122 in the linear direction within the housing 1112. The housing assembly 1110 may be coupled to the actuator 1120, for example, using screws 1116. When coupled together, the lead screw 1122 and the anti-rotation device 1132 are located within the housing 1112 and may be coupled to a piston such as a displacement piston (not shown).

The anti-rotation device 1130 may include a hub 1132, which may be rigidly connected to the lead screw 1122 such that the anti-rotation device 1130 does not rotate relative to the lead screw 1122. The anti-rotation device 1130 may also include radial portions 1134 (e.g., prongs) extending radially from the hub 1132. The radial portions 1134 engage and slide in the grooves 1114 in the housing 1112 to prevent rotation of the anti-rotation device 1130 as the lead screw 1122 moves the anti-rotation device 1130 linearly within the housing 1112. The rotation of the threaded rotor 1124 by the motor 1126 is thus translated into linear motion by the lead screw 1122 as the anti-rotation device 1132 slides within the housing 1112. In one embodiment, the anti-rotation device 1130 includes three radial portions 1134 with an angular spacing of about 120°, although other numbers and configurations are possible.

One or more of the radial portions 1134 may include a slot 1136 to allow the ends of the radial portions 1134 to deflect or compress inwardly providing a spring action. When the radial portions 1134 with the slots 1136 are positioned within the corresponding grooves 1114 of the housing 1112, the ends of the radial portions 1134 compress such that the radial portions 1134 have an interference fit with the grooves 1114, thereby eliminating any clearance between the radial portions 1134 and the sides of the grooves 1114. There may still be clearance between the radial portions 1134 and the floor of the grooves 1114 in the radial direction. In one embodiment, at least the radial portions 1134 of the anti-rotation device 1130 may be made of a plastic material or other suitable low friction resilient material. The housing 1112 may also be made of a plastic material or other suitable low friction material. One example of a suitable low friction resilient material is a thermoplastic PTFE blend, such as the type known as Delrin AF available from Quadrant Engineering Plastics Products. Other examples of a suitable low friction resilient material may include metals having similar characteristics. In other embodiments, other resilient structures may be used to provide or assist the spring action in the radial portions 1134. For example, a spring or rubber material may be provided within the slots 1136 to energize the radial portions 1134.

In use, the actuator 1120 may be operated to provide linear actuation within the housing assembly 1110, for example, in either direction. When the motor 1126 of the actuator 1120 rotates the rotor 1124 threadably engaged with the lead screw 1122, the lead screw 1122 is prevented from rotating by the engagement of the radial portions 1134 of the anti-rotation device 1130 with the grooves 1114 of the housing 1112 and thus translates the rotation into a linear motion. The linear motion of the lead screw 1122 causes the anti-rotation device to slide along the grooves 1114 of the housing 1112. The linear motion of the lead screw 1122 may also cause linear movement of a displacement piston or other structure (not shown) coupled to the lead screw 1122. As described in one example above, the linear movement of a displacement piston may cause displacement of a fluid such as air, which may cause the suction and discharge of fluid in a fluid transfer device.

Consistent with one aspect of the present invention, a fluid displacement apparatus includes a linear actuator and a drive shaft coupled to the linear actuator. The drive shaft may include a first magnetic coupler at one end of the drive shaft. The fluid displacement apparatus may also include a piston magnetically coupled to the drive shaft of the linear actuator. The piston includes a second magnetic coupler at one end of the piston. The second magnetic coupler configured to magnetically engage the first magnetic coupler and configured to mechanically engage the first magnetic coupler if the couplers disengage magnetically. The fluid displacement apparatus may further include a cylinder defining a displacement chamber for receiving the piston.

Consistent with another aspect of the present invention, a magnetic coupling system includes a first magnetic coupler including at least a first magnetic portion and tangs extending axially relative to the first magnetic coupler and radially inwardly toward a longitudinal axis of the first magnetic coupler with the tangs defining a coupling region. The magnetic coupling system further includes a second magnetic coupler configured to engage the first magnetic coupler. The second magnetic coupler includes at least a second magnetic portion and at least one radial portion extending radially outwardly from the second magnetic portion. The radial portion being configured to be received in the coupling region of the first magnetic portion such that the first magnetic portion is configured to magnetically engage the second magnetic portion and the tangs are configured to mechanically engage the radial portion if the magnetic portions disengage magnetically.

Consistent with a further aspect of the present invention, a linear actuator includes a lead screw, a threaded rotor threadably engaging the lead screw and configured to move the lead screw in a linear direction within a housing, and an anti-rotation device attached to the lead screw. The anti-rotation device includes a hub and radial portions extending radially from the hub. The radial portions include ends configured to engage grooves extending longitudinally in the housing. The radial portions may also include slots in the ends such that the ends are configured to compress and engage the respective grooves with an interference fit.

Consistent with yet another aspect of the invention, an apparatus comprises a housing including grooves extending longitudinally along an inner portion of the housing and a linear actuator coupled to the housing. The linear actuator may include a lead screw, a threaded rotor threadably engaging the lead screw and configured to move the lead screw in a linear direction within the housing, and an anti-rotation device attached to the lead screw. The anti-rotation device includes a hub and radial portions extending radially from the hub. The radial portions include ends engaging grooves extending longitudinally in the housing. The radial portions also include slots in the ends such that the ends are compressed and engage the respective grooves with an interference fit.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A fluid displacement apparatus comprising:

a linear actuator;

a drive shaft coupled to the linear actuator, the drive shaft including a first magnetic coupler at one end of the drive shaft, wherein the first magnetic coupler includes at least a first magnetic portion and tangs extending axially relative to the first magnetic coupler and radially inwardly toward a longitudinal axis of the first magnetic coupler, the tangs defining a coupling region;

a piston magnetically coupled to the drive shaft of the linear actuator, the piston including a second magnetic coupler at one end of the piston, the second magnetic coupler configured to magnetically engage the first magnetic coupler and configured to mechanically engage the first magnetic coupler if the couplers disengage magnetically; and a cylinder defining a displacement chamber for receiving the piston.

2. The fluid displacement apparatus of claim 1 wherein the second magnetic coupler includes at least a second magnetic portion and at least one radial portion extending radially outwardly from the second magnetic portion, the radial portion being received in the coupling region of the first magnetic coupler such that the first magnetic portion is configured to magnetically engage the second magnetic portion and the tangs are configured to mechanically engage the radial portion if the magnetic portions disengage magnetically.

3. The fluid displacement apparatus of claim 2 wherein the first magnetic coupler includes at least two of the tangs extending from opposite sides of the first magnetic coupler.

4. The fluid displacement apparatus of claim 3 wherein the radial portion extends annularly around the second magnetic coupler.

5. The fluid displacement apparatus of claim 1 wherein the first magnetic portion includes a first magnet having a pole facing outward, and wherein the second magnetic portion includes a second magnet having an opposite pole facing outward.

6. The fluid displacement apparatus of claim 1 wherein the second magnetic coupler includes a cap secured over the end of the piston.

7. The fluid displacement apparatus of claim 1 further comprising a housing coupled to the linear actuator, wherein the linear actuator includes a lead screw and a threaded rotor threadably engaging the lead screw and configured to move the lead screw in a linear direction within the housing.

8. The fluid displacement apparatus of claim 7 wherein the housing includes grooves extending longitudinally along an inner portion of the housing, and further comprising an anti-rotation device attached to the lead screw, the anti-rotation device including a hub and radial portions extending radially from the hub, the radial portions including ends engaging the grooves extending longitudinally in the housing, the radial portions including slots in the ends such that the ends are compressed and engage the respective grooves with an interference fit.

9. The fluid displacement apparatus of claim 8 wherein the anti-rotation device includes at least three of the radial portions.

10. A magnetic coupling system comprising:

a first magnetic coupler including at least a first magnetic portion and tangs extending axially relative to the first magnetic coupler and radially inwardly toward a longitudinal axis of the first magnetic coupler, the tangs defining a coupling region; and a second magnetic coupler configured to engage the first magnetic coupler, the second magnetic coupler including at least a second magnetic portion and at least one radial portion extending radially outwardly from the second magnetic portion, the radial portion being configured to be received in the coupling region of the first magnetic portion such that the first magnetic portion is configured to magnetically engage the second magnetic portion and the tangs are configured to mechanically engage the radial portion if the magnetic portions disengage magnetically.

11. The magnetic coupling system of claim 10 wherein the first magnetic coupler includes at least two of the tangs extending from opposite sides of the first magnetic coupler.

12. The magnetic coupling system of claim 10 wherein the radial portion extends annularly around the second magnetic coupler.

13. The magnetic coupling system of claim 10 wherein the first magnetic portion includes a first magnet having a pole facing outward, and wherein the second magnetic portion includes a second magnet having an opposite pole facing outward.

14. A linear actuator comprising:

a lead screw;

a threaded rotor threadably engaging the lead screw and configured to move the lead screw in a linear direction within a housing; and an anti-rotation device attached to the lead screw, the anti-rotation device including a hub and radial portions extending radially from the hub, the radial portions including ends configured to engage grooves extending longitudinally in the housing, the radial portions including slots in the ends such that the ends are configured to compress and engage the respective grooves with an interference fit.

15. The linear actuator of claim 14 wherein the anti-rotation device includes at least three of the radial portions.

16. The linear actuator of claim 14 wherein at least the ends of the radial portions of the anti-rotation device are made of a resilient material.

17. An apparatus comprising:

a housing including grooves extending longitudinally along an inner portion of the housing;

a linear actuator coupled to the housing, the linear actuator comprising:

a lead screw;

a threaded rotor threadably engaging the lead screw and configured to move the lead screw in a linear direction within the housing; and an anti-rotation device attached to the lead screw, the anti-rotation device including a hub and radial portions extending radially from the hub, the radial portions including ends engaging grooves extending longitudinally in the housing, the radial portions including slots in the ends such that the ends are compressed and engage the respective grooves with an interference fit.

18. The apparatus of claim 17 wherein at least the ends of the radial portions of the anti-rotation device are made of a plastic material.

19. The apparatus of claim 17 wherein the anti-rotation device includes at least three of the radial portions.

20. A fluid displacement apparatus comprising:

a linear actuator;

a drive shaft coupled to the linear actuator, the drive shaft including a first magnetic coupler at one end of the drive shaft;

a piston magnetically coupled to the drive shaft of the linear actuator, the piston including a second magnetic coupler at one end of the piston, the second magnetic coupler configured to magnetically engage the first magnetic coupler and configured to mechanically engage the first magnetic coupler if the couplers disengage magnetically, wherein the second magnetic coupler includes a cap secured over the end of the piston; and a cylinder defining a displacement chamber for receiving the piston.

* * * * *